US009828689B2

(12) United States Patent
Ookubo

(10) Patent No.: US 9,828,689 B2
(45) Date of Patent: Nov. 28, 2017

(54) ALUMINUM CONDUCTIVE MEMBER AND METHOD FOR PRODUCING SAME

(71) Applicant: NIPPON LIGHT METAL COMPANY, LTD., Tokyo (JP)

(72) Inventor: Manabu Ookubo, Tokyo (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 0 days.

(21) Appl. No.: 14/758,837

(22) PCT Filed: Jan. 24, 2014

(86) PCT No.: PCT/JP2014/051480

§ 371 (c)(1),
(2) Date: Jul. 1, 2015

(87) PCT Pub. No.: WO2014/125896

PCT Pub. Date: Aug. 21, 2014

(65) Prior Publication Data

US 2015/0340116 A1 Nov. 26, 2015

(30) Foreign Application Priority Data

Feb. 12, 2013 (JP) ..... 2013-024615

(51) Int. Cl.

| | |
|---|---|
| ***H01B 3/10*** | (2006.01) |
| ***C25D 11/04*** | (2006.01) |
| ***H01B 13/06*** | (2006.01) |
| ***H01B 13/00*** | (2006.01) |
| ***H01B 1/02*** | (2006.01) |
| ***C25D 11/02*** | (2006.01) |
| ***C25D 11/18*** | (2006.01) |

(52) U.S. Cl.
CPC ..... *C25D 11/04* (2013.01); *C25D 11/022* (2013.01); *C25D 11/18* (2013.01); *H01B 1/023* (2013.01); *H01B 3/10* (2013.01); *H01B 13/0036* (2013.01); *H01B 13/06* (2013.01); *Y10T 29/49119* (2015.01)

(58) Field of Classification Search
CPC ..... H01B 3/10; H01B 3/105
USPC ..... 174/110 A, 126.2
See application file for complete search history.

(56) References Cited

U.S. PATENT DOCUMENTS

| | | | | |
|---|---|---|---|---|
| 4,499,119 | A * | 2/1985 | Smith | H01L 39/2493 204/192.24 |
| 4,681,666 | A | 7/1987 | Potter et al. | |
| 5,472,788 | A * | 12/1995 | Benitez-Garriga | C25D 11/22 205/105 |
| 5,759,291 | A | 6/1998 | Ichinose et al. | |
| 6,288,905 | B1 * | 9/2001 | Chung | B32B 3/08 174/256 |
| 2007/0183120 | A1 * | 8/2007 | Fujimoto | H01G 9/0032 361/528 |
| 2013/0273787 | A1 | 10/2013 | Mitose et al. | |

FOREIGN PATENT DOCUMENTS

| | | | |
|---|---|---|---|
| JP | 9-18034 | A | 1/1997 |
| JP | 2005-123219 | A | 5/2005 |
| JP | 2006-49039 | A | 2/2006 |
| JP | 2009-60757 | A | 3/2009 |
| JP | 2010-15938 | A | 1/2010 |
| JP | 2010-285652 | A | 12/2010 |
| JP | 4759699 | B2 | 8/2011 |
| WO | WO 2012/077740 | A1 | 6/2012 |

OTHER PUBLICATIONS

English translation of International Preliminary Report on Patentability and Written Opinion dated Aug. 27, 2015, in PCT International Application No. PCT/JP2014/051480.
International Search Report, issued in PCT/JP2014/051480, dated Feb. 25, 2014.
European Patent Office Communication and extended search report issued in the corresponding European Patent Application No. 14751112.5 dated Aug. 22, 2016.

* cited by examiner

*Primary Examiner* — Chau N Nguyen
(74) *Attorney, Agent, or Firm* — Birch, Stewart, Kolasch & Birch, LLP

(57) ABSTRACT

Provided are an aluminum conductive member that includes an electrical connection portion excellent in conductivity and rust resistance and an electrical insulation portion excellent in long-term durability, chemical resistance, and the like, and can be manufactured at low cost, and a method of manufacturing the same. Specifically, provided are an aluminum conductive member, including: an aluminum conductive base material formed of an aluminum material including aluminum or an aluminum alloy; an electrical connection portion formed in a region of the aluminum conductive base material, the electrical connection portion having a surface coated with a conductive oxidation preventing film and being used as a terminal; and an electrical insulation portion formed in a region of the aluminum conductive base material other than the region in which the electrical connection portion is formed, the electrical insulation portion being coated with an anodic oxide film, and a method of manufacturing the same.

3 Claims, No Drawings

ALUMINUM CONDUCTIVE MEMBER AND METHOD FOR PRODUCING SAME

TECHNICAL FIELD

The present invention relates to an aluminum conductive member to be used as an insulated bus bar, an insulated bus duct, or the like to be incorporated into various devices for receiving and distributing electric power, controlling devices, and the like in a power demand place such as a plant, a building, or a home, and to a method of manufacturing the same.

BACKGROUND ART

Electric power generated in a power plant or the like is generally transmitted through a high-voltage transmission line to a power demand site, and in the power demand site, distributed through a distribution line to a power demand place such as a plant, a building, or a home after a voltage is reduced in several stages as required. When the electric power is supplied, a transformer for reducing the voltage, a distribution board for distributing the electric power, and the like are used. The transformer, the distribution board, and the like use a device for receiving and distributing the electric power, a controlling device such as a switch, and the like in order to receive and distribute the electric power at a large capacity and a low voltage. In addition, the device for receiving and distributing the electric power, the controlling device, and the like use an insulated bus bar, in which a region other than an electrical connection portion is provided as an electrical insulation portion by being coated with a tubular resin (insulating resin material), or a conductive member called an insulated bus duct, in which a plurality of such insulated bus bars are stacked (for example, Patent Literature 1).

For the conductive member, a copper-based material formed of copper or a copper alloy is mainly used because the copper-based material exhibits excellent performance in conductivity, strength, processability, corrosion resistance, and the like. However, the copper-based material is heavy in weight owing to, for example, copper having a density of 8.95 g/cm$^3$ (20° C.) as compared to an aluminum material formed of aluminum or an aluminum alloy (for example, pure aluminum has a density of 2.699 g/cm$^3$ (20° C.)). For example, in applications demanding weight saving, such as the bus duct to be used as a construction material, the aluminum material, which has a light weight and excellent conductivity, has begun to be used.

However, the aluminum material has the following problems. The aluminum material has a property of being easily oxidized in its surface, and hence when a conductive member formed of the aluminum material (aluminum conductive member) is exposed to external air, its surface is oxidized and an oxide film is easily formed, with the result that contact electrical resistance of the aluminum conductive member is increased owing to the oxide film, and electrical connection to a terminal to be connected is difficult to realize. Besides, when the aluminum conductive member is directly connected to a conductive member having a large difference in standard electrode potential, such as a conductive member formed of the copper-based material, electrical corrosion (electrochemical corrosion) occurs at the contact portion.

In such circumstances, a proposal for solving the problems of the aluminum conductive member has also hitherto been made. For example, in Patent Literature 2, there is a proposal of a plating method for imparting satisfactory conductivity and satisfactory rust resistance to a bus bar (aluminum bus bar) to be used in a bus duct. However, in such plating method, in which conductivity and rust resistance are imparted to the aluminum bus bar, plating is performed also on a region of the electrical insulation portion other than the electrical connection portion, which does not need conductivity. This disadvantageously entails a higher cost as the aluminum bus bar or the bus duct using the aluminum bus bar has a larger size. In addition, in Patent Literature 2, there is no disclosure of a method of forming the electrical insulation portion in a region other than the electrical connection portion, which is required in the case of using the aluminum bus bar as an insulated bus bar or an insulated bus duct. If the electrical insulation portion is formed with an insulating coating using a tubular resin or the like, there is a problem in that its long-term durability, chemical resistance, and the like depend on the resin in the electrical insulation portion.

It should be noted that, in Patent Literature 3, there is a disclosure of a housing made of an aluminum alloy for storing an electric vehicle secondary battery, the housing having on its surface a hard anodic oxide film having a thickness of from 20 μm to 100 μm and doubling as a bus bar. However, in Patent Literature 3, there is no disclosure of, for example, how the electrical connection portion to be used as a terminal is formed and how the conductivity and rust resistance of the formed electrical connection portion are ensured.

CITATION LIST

Patent Literature

[PTL 1] JP 2009-060757 A
[PTL 2] JP 2010-285652 A
[PTL 3] JP 4759699 B2

SUMMARY OF INVENTION

Technical Problem

In view of the foregoing, the inventors of the present invention have made extensive investigations on an aluminum conductive member that uses as a base material an aluminum material formed of aluminum or an aluminum alloy, can be manufactured at low cost without using a plating method or an insulating resin material, and includes: an electrical connection portion excellent in conductivity and rust resistance, which are required in use as an insulated bus bar, an insulated bus duct, or the like; and an electrical insulation portion excellent in long-term durability, chemical resistance, and the like. Thus, the present invention has been completed.

Accordingly, an object of the present invention is to provide an aluminum conductive member that includes an electrical connection portion excellent in conductivity and rust resistance and an electrical insulation portion excellent in long-term durability, chemical resistance, and the like, and can be manufactured at low cost.

In addition, another object of the present invention is to provide a method of manufacturing an aluminum conductive member, for manufacturing an aluminum conductive member that includes an electrical connection portion excellent in conductivity and rust resistance and an electrical insulation portion excellent in long-term durability, chemical resistance, and the like, at low cost.

Solution to Problem

That is, according to one embodiment of the present invention, there is provided an aluminum conductive member, including: an aluminum conductive base material formed of an aluminum material including aluminum or an aluminum alloy; an electrical connection portion formed in a region of the aluminum conductive base material, the electrical connection portion having a surface coated with a conductive oxidation preventing film and being used as a terminal; and an electrical insulation portion formed in a region of the aluminum conductive base material other than the region in which the electrical connection portion is formed, the electrical insulation portion being coated with an anodic oxide film.

According to another embodiment of the present invention, there is provided a method of manufacturing an aluminum conductive member, the method including: forming an aluminum conductive base material by using an aluminum material including aluminum or an aluminum alloy; forming an electrical insulation portion coated with an anodic oxide film by subjecting a surface of the aluminum conductive base material to anodic oxidation treatment; and forming an electrical connection portion coated with a conductive oxidation preventing film by applying a conductive oxidation preventing agent onto a surface of the aluminum conductive base material.

In the present invention, the material, shape, and the like of the aluminum material to be used as the aluminum conductive base material are not particularly limited as long as the anodic oxide film can be formed on the surface of the aluminum material through the anodic oxidation treatment. The material, shape, and the like of the aluminum material may be appropriately selected and the aluminum conductive base material may be appropriately formed depending on various physical properties such as strength, corrosion resistance, and processability required in, for example, applications of the aluminum conductive member to be manufactured by using the aluminum conductive base material.

In addition, in the present invention, the thickness of the anodic oxide film, which is formed on the surface of the aluminum conductive base material through the anodic oxidation treatment and functions as the electrical insulation portion, may be appropriately set as long as the anodic oxide film exhibits an electrical insulating property (resistance value) at such a level that the anodic oxide film functions as the electrical insulation portion of the aluminum conductive member. It is desired that the lower limit of the thickness be generally 10 μm or more, preferably 50 μm or more, from the viewpoint of preventing generation of cracks in the film to more effectively prevent generation of insulation breakdown. In addition, while there is no particular limitation on the upper limit of the thickness from the viewpoint of the insulation breakdown, the upper limit is desirably up to about 100 μm from a manufacturing viewpoint.

In addition, in order to prevent a reduction in insulation resistance or dielectric strength voltage, it is desired that the anodic oxide film, which functions as the electrical insulation portion, be subjected to sealing treatment with preferably boiling water or pressurized water vapor. The anodic oxide film is more preferably colored by, for example, a method such as an electrolytic coloring method, a dyeing method, or an electrophoresis method, or a method combining those methods, to be desirably visually distinguished from the electrical connection portion by virtue of the coloring.

In the present invention, the electrical connection portion, which is formed in a region of the aluminum conductive base material and used as a terminal, needs to have its surface coated with the conductive oxidation preventing film, that is, needs to be subjected to rust prevention treatment while conductivity is ensured. There is no particular limitation on the conductive oxidation preventing film as long as conductivity and rust resistance to be required can be ensured. As the conductive oxidation preventing film, there may be given, for example, a conductive oxidation preventing film formed by applying, onto part of the surface of the aluminum conductive base material, a conductive coating agent obtained by mixing conductive powder such as chromium oxide powder into grease (for example, trade name "Nikkei Jointal" manufactured by Shizuoka Kosan Co., Ltd.) or a conductive coating agent obtained by adding a conductive filler and as required an oxidation preventing agent to a binder resin, followed by mixing (see, for example, JP 2005-26187 A, JP 2007-317489 A, or JP 2010-539650 A).

In the manufacturing of the aluminum conductive member of the present invention, first, the aluminum conductive base material is formed by using the aluminum material formed of aluminum or an aluminum alloy. Then, the electrical insulation portion coated with the anodic oxide film is formed on the surface of the obtained aluminum conductive base material through the anodic oxidation treatment. In addition, the electrical connection portion coated with the conductive oxidation preventing film is formed by applying the conductive oxidation preventing agent.

Herein, in the formation of the electrical insulation portion and the electrical connection portion, for example, the electrical insulation portion may be formed by subjecting the entire surface of the aluminum conductive base material to the anodic oxidation treatment to form the anodic oxide film, followed by removing the anodic oxide film in a region to serve as the electrical connection portion by a method employing polishing treatment or the like, and the electrical connection portion may be formed by applying the conductive oxidation preventing agent to the region in which the anodic oxide film is removed.

In addition, as another method, the electrical insulation portion may be formed by forming a protective film in a region of the aluminum conductive base material to serve as the electrical connection portion, followed by subjecting a region of the aluminum conductive base material other than the region in which the protective film is formed to anodic oxidation treatment to form the anodic oxide film, and the electrical connection portion may be formed by applying the conductive oxidation preventing agent to a region in which the protective film has been removed.

In addition, the treatment conditions in the anodic oxidation treatment for forming the anodic oxide film to form the electrical insulation portion may be appropriately set as long as the anodic oxide film can be formed to have a thickness that allows an electrical insulating property to be exhibited at such a level that the anodic oxide film functions as the electrical insulation portion, preferably have a thickness of 10 μm or more. For example, in the case of performing the anodic oxidation treatment using as an electrolytic bath a sulfuric acid bath having a concentration of 16 mass %, the anodic oxidation treatment is desirably performed under the treatment conditions of a bath temperature of 20° C., a current density of 150 A/m$^2$, and a treatment time period of 22 min or more.

In addition, the conductive oxidation preventing agent to be used for forming the electrical connection portion formed of the conductive oxidation preventing film only needs to be applied onto part of the surface of the aluminum conductive base material and capable of forming the conductive oxidation preventing film to be required. For example, the conductive coating agents exemplified above and the like may be given.

Advantageous Effects of Invention

In the aluminum conductive member of the present invention, the electrical insulation portion is electrically insulated with the anodic oxide film and hence exhibits excellent long-term durability, excellent chemical resistance, and the like, and the electrical connection portion is coated with the conductive oxidation preventing film and hence exhibits conductivity and rust resistance to be required. Besides, the aluminum conductive member of the present invention can be manufactured at low cost because plating treatment or coating treatment using an insulating resin material is not required.

DESCRIPTION OF EMBODIMENTS

Embodiments of the present invention are hereinafter described by way of Example.

EXAMPLE

An aluminum conductive base material measuring 200 mm×30 mm×4 mm was cut out from an A1100 aluminum material having a thickness of 4 mm. The aluminum conductive base material was subjected to anodic oxidation treatment in a sulfuric acid electrolytic bath having a concentration of sulfuric acid of 160 g/L under the treatment conditions of a bath temperature of 9° C., a DC current density of 400 A/m$^2$, and a treatment time period of 60 min. Thus, an anodic oxide film having a thickness of 60 μm was formed on the entire surface of the aluminum conductive base material.

Next, the anodic oxide film formed on the surface of the aluminum conductive base material was subjected to polishing treatment and removed in regions within 1 cm from both ends of the aluminum conductive base material in a length direction thereof. A conductive coating agent (trade name: Nikkei Jointal Z, manufactured by Shizuoka Kosan Co., Ltd.) was applied to the regions in which the anodic oxide film was removed, to form a conductive oxidation preventing film. Thus, a test piece (aluminum conductive member) including an electrical insulation portion coated with the anodic oxide film and electrical connection portions coated with the conductive oxidation preventing film was prepared.

The obtained test piece was examined for conductivity between the electrical connection portions formed at the both ends with a tester. As a result, satisfactory conduction was confirmed. In addition, the obtained test piece was examined for conductivity of the electrical insulation portion between the electrical connection portions with the tester. As a result, conduction was not observed, and a satisfactory insulating property was confirmed.

As is apparent from the results, the aluminum conductive member including the electrical insulation portion coated with the anodic oxide film and the electrical connection portion coated with the conductive oxidation preventing film can be used as an insulated bus bar, an insulated bus duct, or the like, and can be utilized in the fields of various devices for receiving and distributing electric power, controlling devices, and the like.

The invention claimed is:

1. A method of manufacturing an aluminum conductive member the method comprising the steps of:

providing an aluminum conductive base material comprising aluminum or an aluminum alloy;

subjecting an entire surface of the aluminum conductive base material to an anodic oxidation treatment so that an anodic oxide film, as an electrical insulation portion, is formed on the aluminum conductive base material;

partially removing the anodic oxide film from the aluminum conductive base material to form a region to serve as an electrical connection portion; and coating a conductive coating agent for preventing oxidation to the region in which the anodic oxide film is removed to form a conductive oxidation preventing film on the surface of the aluminum conductive base material, so that the electrical connection portion coated with the conductive oxidation preventing film is formed, wherein the conductive coating agent for preventing oxidation is a conductive coating agent obtained by mixing conductive powder into grease or by adding a conductive filler and an oxidation preventing agent to a binder resin.

2. The method of manufacturing an aluminum conductive member according to claim 1, wherein the anodic oxide film formed on the surface of the aluminum conductive base material is removed by polishing treatment.

3. A method of manufacturing an aluminum conductive member the method comprising the steps of:

providing an aluminum conductive base material comprising aluminum or an aluminum alloy;

forming a protective film on a surface of aluminum conductive base material in a region to serve as an electrical connection portion;

subjecting a region of the aluminum conductive base material other than the region in which the protective film is formed to anodic oxidation treatment to form the anodic oxide film, as an electrical insulation portion, on the surface of the aluminum conductive base material;

removing the protective film from the surface of the aluminum conductive base material; and coating a conductive coating agent for preventing oxidation to the region to serve as the electrical connection portion to form a conductive oxidation preventing film on the surface of the aluminum conductive base material, so that the electrical connection portion coated with the conductive oxidation preventing film is formed, wherein the conductive coating agent for preventing oxidation is a conductive coating agent obtained by mixing conductive powder into grease or by adding a conductive filler and an oxidation preventing agent to a binder resin.

* * * * *